United States Patent [19]

Cole

[11] Patent Number: 4,835,978

[45] Date of Patent: Jun. 6, 1989

[54] ICEMAKER WITH IMPROVED BAIL MECHANISM

[75] Inventor: Ronald E. Cole, Greenwood, Ind.

[73] Assignee: Emhart Industries, Inc., Indianapolis, Ind.

[21] Appl. No.: 189,757

[22] Filed: May 3, 1988

[51] Int. Cl.[4] ..... F25C 5/18

[52] U.S. Cl. ..... 62/137; 62/344

[58] Field of Search ..... 62/137, 344, 233, 347

[56] References Cited

U.S. PATENT DOCUMENTS 3,280,578 10/1966 Linstromberg ..... 62/137

3,623,336 11/1971 Fox ..... 62/344 X 3,712,076 1/1973 Fox ..... 62/344 X

*Primary Examiner*—William E. Tapolcai

*Attorney, Agent, or Firm*—Carl A. Forest

[57] ABSTRACT

There is an ice tray, an ejector for ejecting ice from the tray, an ice storage bin, a mechanism for delivering ice to the tray, a bail mechanism, and a motor for driving the ejector, water delivery mechanism, and bail mechanism. The bail mechanism includes a bail and a bail switch. The motor, via the bail mechanism, raises the bail from a lower position in which the switch energizes the icemaker to an upper position in which the switch opens and the icemaker is de-energized, then permits the bail to return to the lower position if the ice bin is not full. The bail is also manually raisable to a latch-up position to manually de-energize the icemaker. A compound spring provides a bias force to return the bail to the energizing position. The spring provides a weak return force over the range in which the motor drives the bail, a strong force in the range just prior to latch-up, and an intermediate force in the intermediate range. The bail mechanism is designed so that the spring forces the bail in one direction in the three ranges mentioned above and in the opposite direction upon latch-up.

10 Claims, 9 Drawing Sheets

FIG. 6
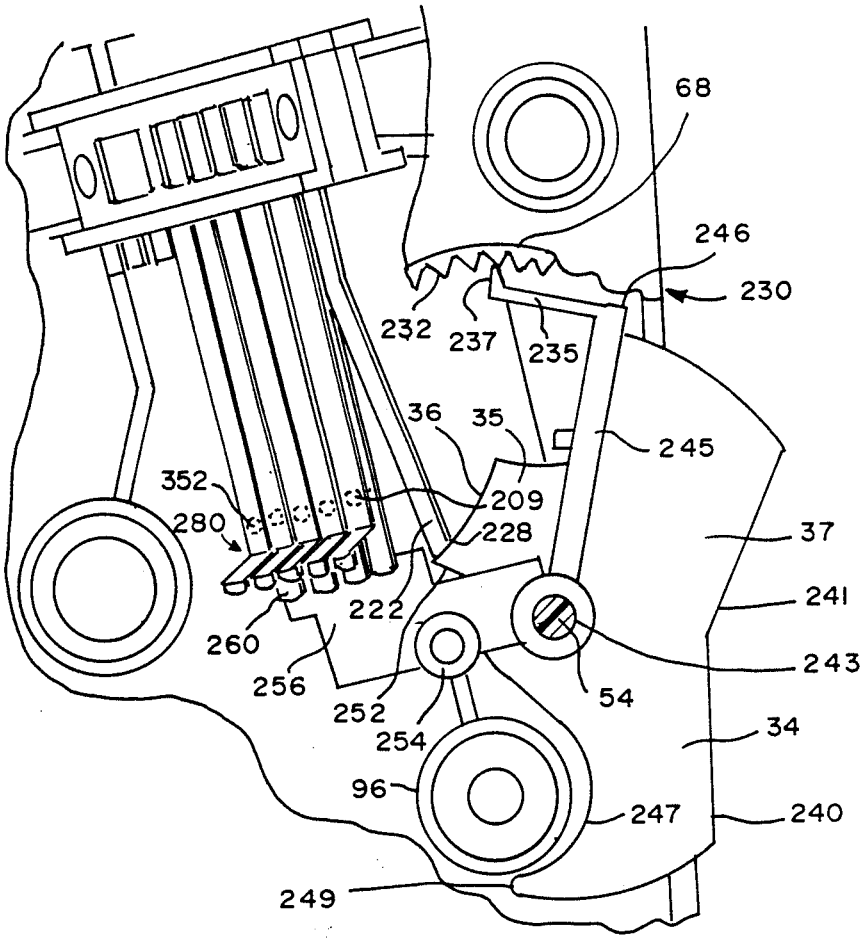
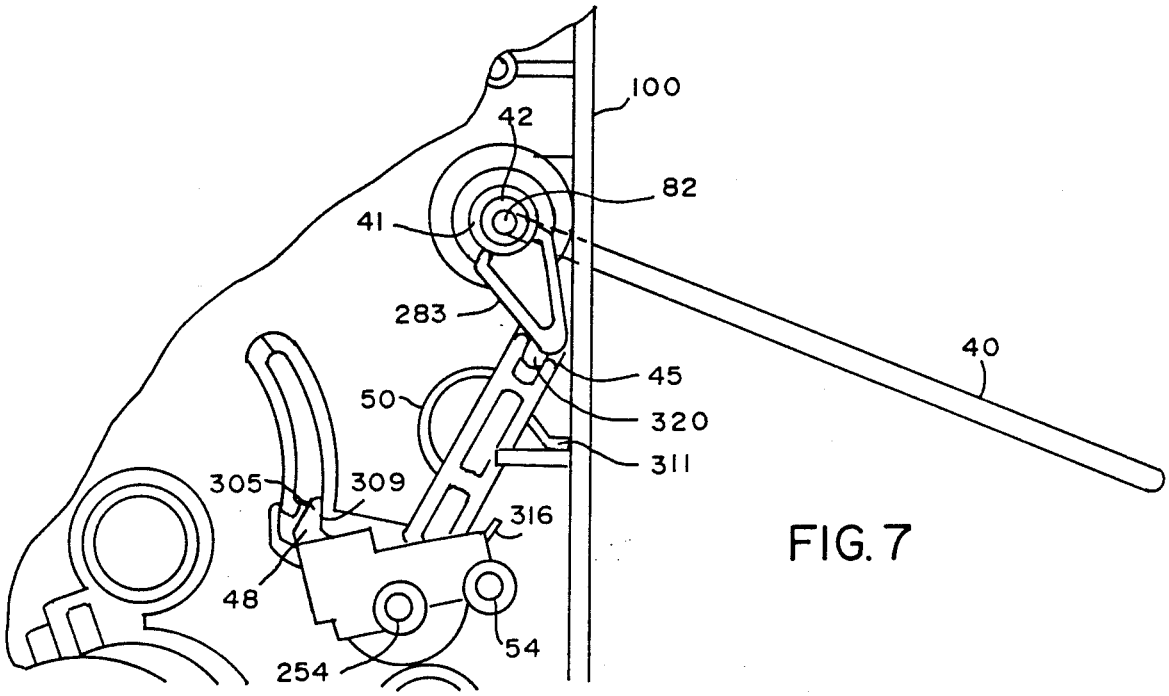
FIG. 7

ICEMAKER WITH IMPROVED BAIL MECHANISM

BACKGROUND OF THE INVENTION

1. Field of the Invention.

The invention in general relates to automatic ice making systems and more particularly to an icemaker having a bail mechanism that is more reliable than the bail mechanisms of prior art icemakers and provides a better feel when manually operated.

2. Description of the Prior Art.

In this patent the term bail means any movable member. This term includes hoops and bars but is not intended to be limited to such structures. U.S. Pat. No. 2,717,497 issued to E. J. Knerr and U.S. Pat. No. 3,299,656 issued to W. J. Linstromberg et al disclose prior art icemakers of the type to which the present invention relates. Each of the icemakers described in these patents includes a bail which during the icemaker cycle is driven by a motor to a position in which the icemaker is de-energized and then allowed to return to a position in which the icemaker is energized provided that the ice storage bin is not full. If the bin is full, then the bail cannot return to the energizing position and the icemaker does not operate until some ice is removed. In each device the bail can also be manually latched up in the de-energized position even if the bin is not full. In each of the icemakers the bail is also biased by a force toward the energizing position. In the Knerr icemaker, the bias force is provided by gravity while in Linstromberg et al the bias force is provided by a torsion spring. In both cases the bias force is essentially constant over the full range of motion of the bail, or at most varying by a small factor related to the change in the gravity vector on the weight in Knerr or following Hooks law for torsion springs in Knerr.

SUMMARY OF THE INVENTION

It is an object of the invention to provide an icemaker having a bail mechanism that is biased toward the energizing position by a bias force that is qualitatively different over different ranges of the bail movement.

It is another object of the invention to provide the above object in an icemaker in which the bail return bias force is relatively small in the range of bail movement over which the bail is driven by the icemaker motor, thus permitting smaller and less expensive motors than in prior art icemakers.

It is another object of the invention to provide one or more of the above objects in an icemaker in which the bail return bias force is relatively large in the range of bail movement over which the bail moves just prior to latch-up, thus preventing inadvertent de-energization of the icemaker.

It is a further object of the invention to provide one or more of the above objects in an icemaker in which the bail return bias force is an intermediate force in the range of movement intermediate the range in which the motor drives the bail and the range just prior to latch-up.

Still a further object of the invention is to provide an icemaker having a compound bail return spring.

Yet a further object of the invention is to provide an icemaker having an improved bail latching mechanism.

The invention provides in an icemaker of the type comprising water holding means for holding water in a cold area to form ice bodies, water delivery means for delivering water to the water holding means, ice mover means for moving ice from the holding means into an ice storage bin; and control means for controlling the operation of the icemaker, the control means including bail means for moving between a position for operating the icemaker and a position for stopping the icemaker, bias means for biasing the bail means towards the position for operating the icemaker, drive means for moving the bail means to the stopping position and returning it to the operating position provided the bin is not filled to a predetermined level, and latching means for latching the bail means in stopping position to thereby de-energize the icemaker regardless of the amount of ice in the storage bin, the improvement wherein the bias means comprises a compound bias means for biasing the bail means towards the operating position with a first bias force over a first range of movement of the bial means and for biasing the bail means towards the operating position with a second bias force qualitatively greater than the first bias force over a second range of movement, the first range including the range of movement over which the drive means moves the bail means, and the second range including a range over which the bail means moves just prior to the position at which the latching means operates.

Preferably, the second bias force is two or more times greater than the first bias force. Preferably the bias means further comprises means for biasing the bail means with third bias force over a range of movement of the bail means between the first and second ranges, the third bias force being between the first and second bias forces.

Preferably the compound bias means includes spring means for responding as a torsion spring over the first range of movement and as a leaf spring over the second range of movement. Preferably the compound bias means comprises an arm, a spring having a first end and a second end, and a first stop means for stopping the movement of the first end of the spring over the first, second, and third ranges of movement, and wherein the second end of the spring is free to move over the first range of movement and the arm engages the spring between the first and second ends of the spring. Preferably a portion of the spring between the first end and the point of engagement of the arm and the spring comprises a torsion spring. Preferably the icemaker further includes second stop means for stopping the movement of the second end when the bail means is in the second range. Preferably, the second stop means further comprises means for stopping the motion of the second end in a first direction while permitting it to move in a second direction when the bail means is in the third range.

Preferably, the bail means includes a bail rotatable about an axis, and the bias means urges the bail in one direction about the axis when the bail means is in the second range and urges the bail in another direction when the bail means is in the latching position. Preferably the latching means comprises a finger through which the bias means acts on the bail, a bearing surface connected or connectable to the bail and rotatable about the axis, the bearing surface having a recess therein, wherein the finger slides against the bearing surface when the bail means is in the second range of movement and enters the recess as the bail means reaches the latching position, and wherein the finger, the bearing surface and the recess are shaped so that the action of the bias means acting through the finger on the bearing surface is in a direction tending to rotate the surface in the one direction about the axis when the bail means is in the second range and is either in a direction through the axis or in a direction tending to rotate the surface in the opposite of the one direction when the finger enters the recess.

The icemaker according to the invention makes it possible to avoid compromises that made prior art icemakers more expensive and less reliable. In prior art icemakers the bail return force had to be made large. Otherwise the return force during the latch-up phase would be too small so that accidental bail lockup could occur regularly simply by ice cubes bouncing during ejection, particularly when through the door ice augers were used in conjunction with the ice makers. As a result larger and more expensive motors than necessary had to be used. In addition the icemaker according to the invention provides a more satisfying feel associated with the bail mechanism, since the freer movement of the bail in the range where the motor drives it suggests that the mechanism is operating properly and the bial strongly signals to the manual operator when the latch-up position is approaching. Numerous other features, objects and advantages will become apparent from the following detailed description when read in conjunction with the accompanying drawings.

BRIEF DESCRIPTION OF THE DRAWINGS

In the drawings:

FIG. 6 is a another view of the mechanism of FIG. 5 with the switch at a setting that shows detail of the engagement of the ramp and the switch blade;

FIG. 7 is a detailed view of the bail mechanism and the switch it controls with the bail in the locked up position;

DESCRIPTION OF THE PREFERRED EMBODIMENT

Figure 1:
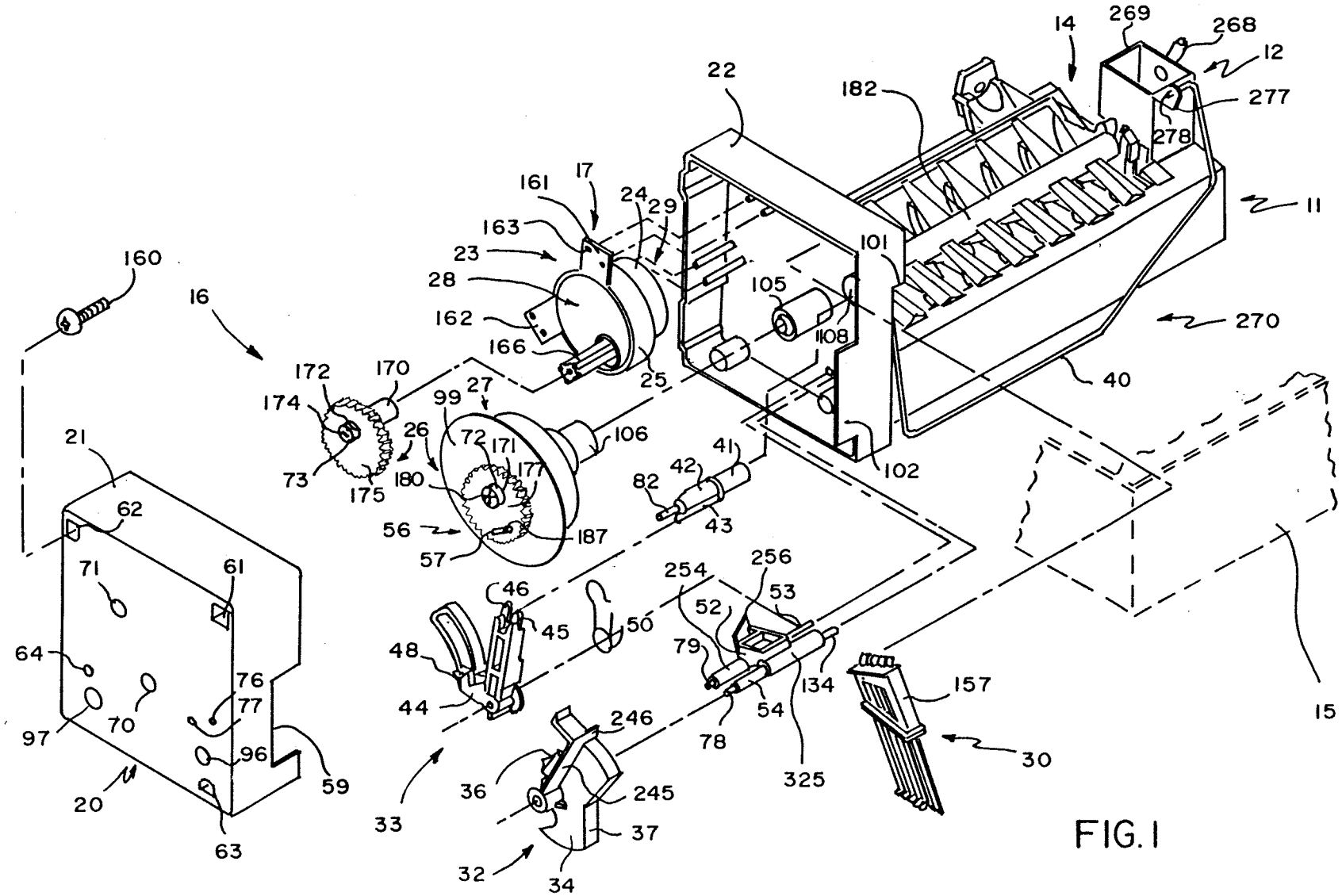
FIG. 1 is an exploded view of an icemaker according to the invention.

Directing attention to FIG. 1, an exploded perspective view of an icemaker according to the invention is shown. This embodiment is intended only to be exemplary of the invention in order to illustrate it, and is not intended to be limiting of the invention, since many other embodiments of the invention are possible. In order to facilitate the discussion of the embodiment shown, we shall consider the portion of the icemaker to the lower left in FIG. 1 to be the front, since it is generally located in the front when the icemaker is mounted in a refrigerator freezer; however, other orientations are possible. In order to clearly illustrate the general orientation of the larger parts, not all details of the icemaker and its parts are shown in FIG. 1.

The preferred embodiment of the icemaker according to the invention includes a water holding means 11 for holding water in a cold area, generally the interior of the freezing compartment of a refrigerator, to form ice bodies, a water delivery means 12 for delivering water to the water holding means 11, an ice mover means 14 for moving ice from the water holding means 11 to an ice storage bin 15, a control means 16 for controlling the operation of the delivery means 12 and the mover means 14, and a drive means 17 for driving the mover means and the control means 16. Much of the control means 16 and the drive means 17 is enclosed and supported within a control housing 20 which includes a front or first portion 21 and a back or second portion 22. Drive means 17 includes a drive housing 23 which includes a portion 24 which houses a motor 29 and a portion 25 which houses a gear train 28. Drive means 17 also includes gearing 26 external of gear housing 25 and a one-way clutch 190 (FIG. 16) enclosed in drive housing 23. Control means 16 includes a cam means 27, a ganged switches 30 which are open and closed by the cam means 27, an adjusting means 32 for manually adjusting the quantity of water delivered to the water holding means 11, and a bail mechanism 33 for de-energizing the icemaker automatically whenever the ice bin is full or manually whenever desired. The means 32 for manually adjusting the quatity of water delivered includes an integral adjustment member 34 having a first portion 35 including a ramp 36 engagable with one of switch blades of the switch gang 30 to adjust the water quantity and a second portion 37 which is manually engagable. The bail mechanism 33 includes a bail 40. Once each cycle of the icemaker, the drive means 17 drives the bail to the "up" position which de-energizes the icemaker then returns it to the "down" or energizing position unless the bin is filled with ice. The bail 40 can also be manually latched in the "up" position to de-energize the icemaker even if the ice bin is not full. The bail 40 is connectable via connector 41 to a member 42 having a bearing surface 43 which interacts with fingers 45 and 46 of pivotable member 44 to move finger 48 which lifts and releases switch blades 60 of gang 30 (FIG.5) to de-energize and energize the icemaker. A compound spring 50 biases the bail 40 toward the "down" position in which the icemaker is energized and provides three different bias forces over three different ranges of motion of the bail, i.e. a relatively light bias forms over the range that the drive means 17 drives the bail for automatically sensing the amount of ice in the bin, which provides ease of operation with a relatively small motor, a relatively strong bias force over the range just prior to the manual latching position, which strong bias force prevents accidental lockup, and an intermediate bias force in an in-between range, which provides a good "feel" to manual movement of the bail. Brace 52 provides shafts 53 and 54 on which adjusting means 32 and pivotable member 44 pivot and also braces the gang switch 30 as will be described below. The icemaker also includes an anti-back means 56 (FIGS. 1 and 2) which includes a resilient pawl 57 on gear 177 and a ratchet member 58 (FIG. 2) integrally formed with the front control housing position 21.

Figure 2:
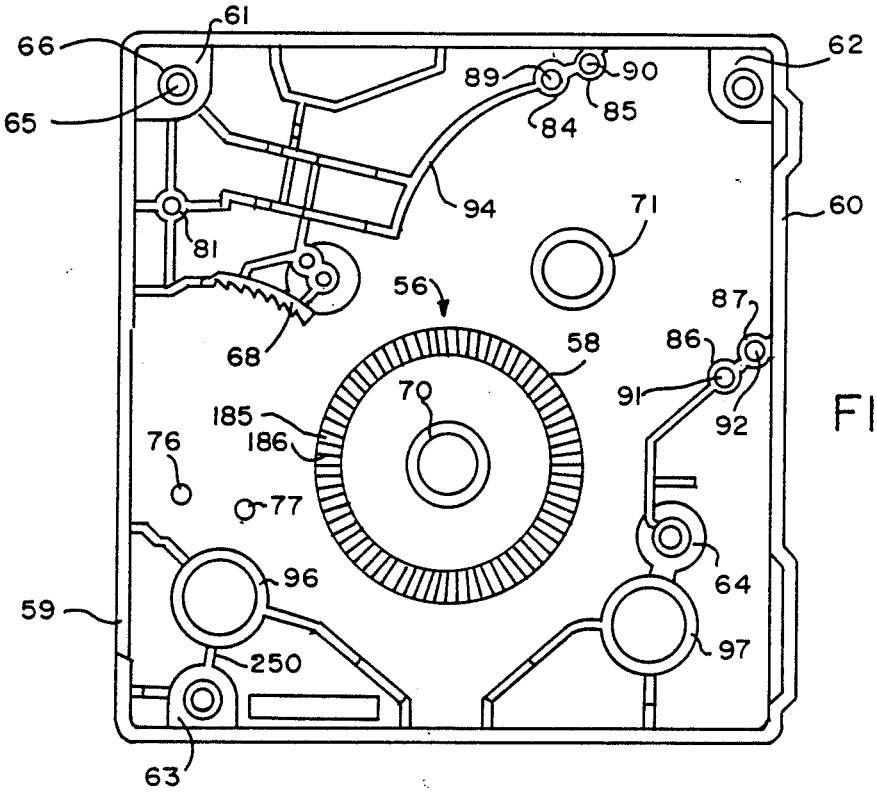
FIG. 2 is an orthogonal detailed view of the inside of the front portion of the control housing.

Turning now to a more thorough description of the details of the icemaker, FIG. 2 shows a view looking into the back of the front or first portion 21 of the control housing 20. This first housing portion 21 includes an outer housing wall 60, having an indented area 59 through which adjusting member 37 extends, and four screw seats 61, 62, 63, and 64 each with a screw hole, such as 65, and each with a short post, such as 66, providing additional strength directly under each screw head; housing 21 also includes a notched member 68 which forms part of the water quantity adjusting means 32, ratchet member 58, bearings 70 and 71 for supporting the cam shaft 72 (FIG. 1) and drive gear shaft 73 respectively, openings 76 and 77 in which the tips 78 and 79 (FIG. 1) of brace 52 fit, socket 81 in which the tip 82 (FIG.1) of rotatable member 42 rotates, posts 84, 85, 86 and 87 having channels 89, 90, 91 and 92 respectively therein, and webbing, such as 94, supporting and strengthening the housing in critical places and bracing many of the housing elements discussed above. Large cylindrical-walled ports 96 and 97 provide access from the front of the housing to screws, such as 160 (FIG. 1), which fasten water holding means 11 and the control housing 20 together.

Figure 3:
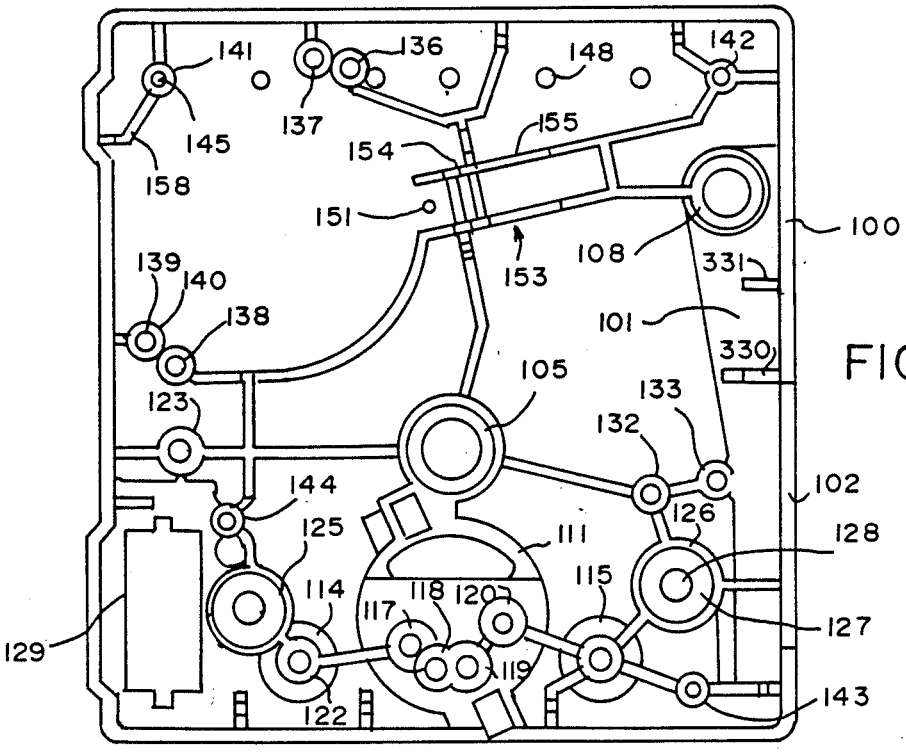
FIG. 3 is an orthogonal detailed view of the inside of the back portion of the control housing.

FIG. 3 shows a view of the inside of the back or second control housing portion 22. This housing portion 22 includes outer housing wall 100 having an indentation 101 in which bail 40 rests in the down position, and a flange extension 102 which closes the back portion of indentation 59 in front cover portion 21 leaving an opening just large enough for manual contact member 37 of adjusting means 32 to extend; housing portion 22 also includes bearing support 105 which provides a bearing for cam shaft 106, bearing support 108 which provides a bearing for the connector shaft 41 (FIG. 1) of rotatable member 42, cup 111 in which thermostat 112 seats, hollow cylindrical chambers 114 and 115 in which the heater 113 seats, hollow cylindrical sockets 117, 118, 119 and 120 which hold the female portion of electrical connectors for the thermostat, cylindrical sockets 121 and 122 which hold the female portion of electrical connectors for the heaters, and socket 123 which holds a female connector which provides ground access, wells 125 and 126 which provides continuation of screw access ports 96 and 97 in the front control housing portion 21 and each of which includes a seat, such as 127, with a bore 128 through it for seating and holding a screw 160, slot 129 for inserting an electrical connector, sockets 132 and 133 for receiving shaft 53 and stem 131 (FIG. 1) of brace 52, pins 136, 137, 138 and 139 which fit into channels 89, 90, 91 and 92 respectively in front portion 21, collars such as 140 about each of pins 136–139, each pin having a molded-in support post, such as 135, (FIG. 14) supporting it, cylindrical studs 141, 142, 143 and 144 each of which has a threaded bore, such as 145, which receive screws such as 160 (FIG. 1), five ventilation holes, such as 148, for ventilating the control housing, an access hole 151 for use in alignment of elliptical gears 175 and 177, a frame 153 having a notched portion 154 and a slped portion 155 shaped to mesh with and hold bracket 157 (FIG. 1) that holds switch gang 30 together, and other webbing structing, such as 158, which supports the various structures listed above and reinforces the housing at critical places. The two control housing portions 21 and 22 are held together with screws, such as 160, passing through screw holes, such as 65, in screw seats 61-64 and screwing into threaded bores, such as 145, in studs 141–144.

THE DRIVE MEANS

Figure 13:
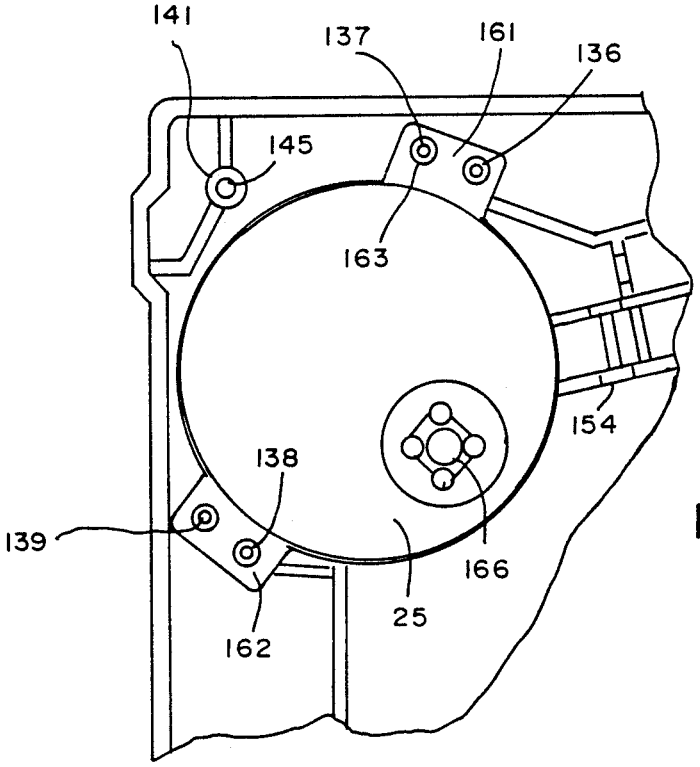
FIG. 13 is a front view of the motor and gear box mounted on the back housing portion.
Figure 14:
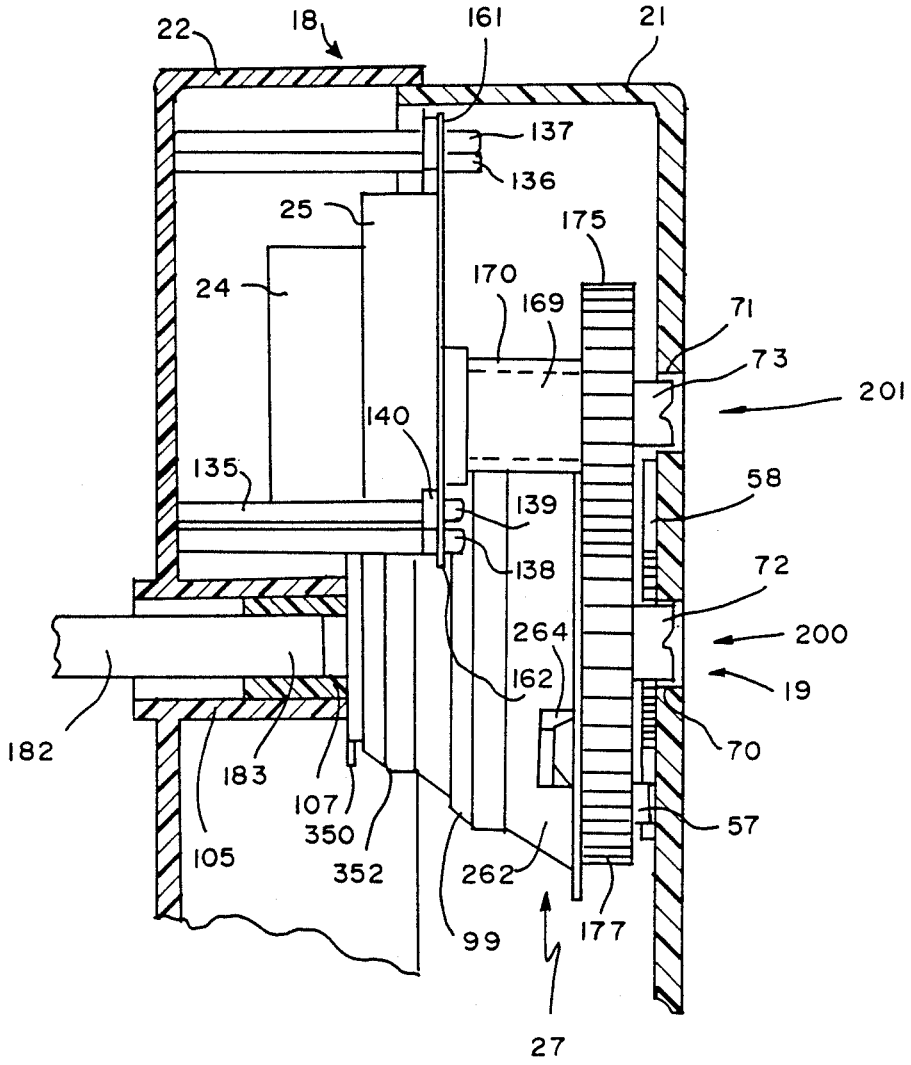
FIG. 14 is a side view of the motor, gear box and portion of the icemaker control mechanism, partially cross-sectioned to show how they are mounted in the control housing.

Turning now to FIGS. 13 and 14, in addition to FIGS. 1-3, the drive means and the drive mounting means 19 will be discussed. The drive housing 23 has a pair of attached flanges 161, 162 each of which has two circular openings, such as 163, which are of a size and position such that they fit snugly over pins 136–139. In FIG. 13 the difference in size between the openings 163 and pins 136–139 is greatly exaggerated to distinguish the two. Upon tightening screws 160, the flanges 161 and 162 are captured between collars 140 and posts 84–87, thus firmly holding the drive housing 23 in the control housing 20. The motor 29 and gearing 28 in drive housing 23 are conventional, preferably the Model M008 motor and gear train made by Mallory Timers Company, P.O. Box 706, Indianapolis, IN 46206, and will thus not be discussed, except to say that this motor and gear train is approximately half the size and weight of prior art motor and gear trains in icemakers. The output of the housed gear train 28 is a "square" drive shaft 166. Although shaft 166 has rounded corners and is indented between the corners, it is conventionally of the type known in the art as a "square drive". Shaft 166 fits into a socket 169 in connector 170. Socket 169 is square with rounded corners and is slightly larger than the end of shaft 166, providing a small degree of looseness in the connection. Connector 170 is preferably cylindrical externally and has a pair of cylindrical shaft extensions 172 and 73 extending from the end. Gear 175 has a hole offset from its center which hole is of a size so that the gear can be press-fitted on shaft extension 172. Shaft extension 73 fits rotatably into bearing 71 in housing front protion 21 as discussed above. The end of shaft 73 has a one-way screwdriver head 174 formed in it permitting it to be driven counter-clockwise, as viewed in FIG. 1, by a hand or powered screwdriver. Gear 175, connector 170, extension 73 and one way head 174 can be integrated into one molded part. Camstack 99 has a cylindrical shaft molded on its axis which shaft has a larger diameter portion 171 and smaller diameter portion 72. Gear 177 has an off-center hole in it of a size that portion 171 of the shaft may be press-fitted into it. Portion 72 acts as a cam shaft and rotates in bearing 70. Gears 175 and 177 are as described in my U.S. Pat. No. 4,697,432, which is incorporated herein by reference, and produce a slower camshaft speed when harvest rake 182 is removing ice from holding means 11. The end of shaft 72 has a one-way screwdriver head formed in it permitting it to be driven by a screwdriver in a clockwise direction. Camstack 99 is a conical camstack as described in my co-pending U.S. patent application Ser. No. 144,161, which is incorporated herein by reference. It is preferably molded of a single piece including shafts 171 and 72 and a shaft 106 at the end opposite shaft 72. This shaft 106 turns in bearing 105 in back housing porition 22. Shaft 106 has a cylindrical recess 107 molded in it with a flat on one side shaped to fit the end 183 of rake 182.

Figure 15:
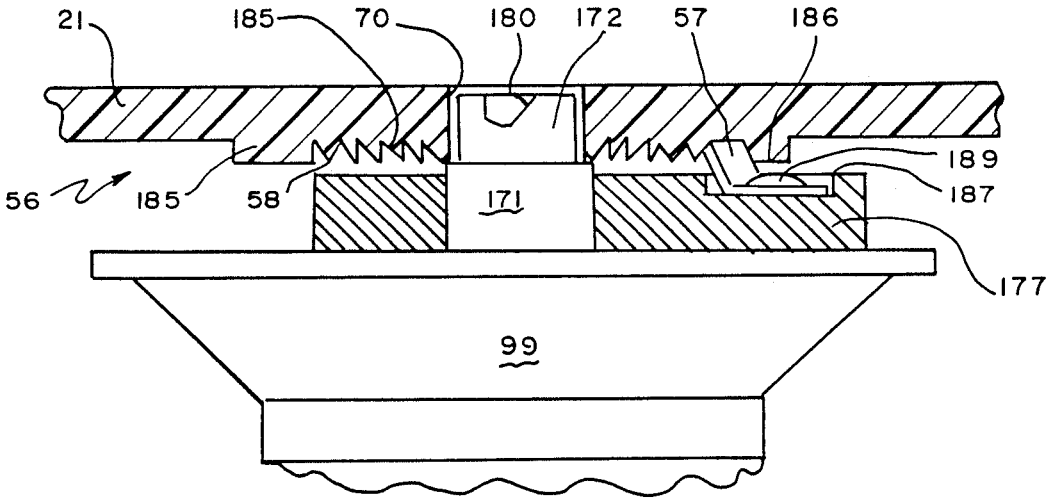
FIG. 15 is a partial cross-section showing detail of the anti-back mechanism.

Turning now to FIG. 15 the anti-back mechanism is shown. The anti-back mechanism comprises a means 56 for preventing the gear train 26, 28 from being driven in the direction reverse to the direction in which it is driven by motor 29. As discussed above, the means 56 includes a ratchet member 58 and a pawl member 57. Ratchet member 58 comprises a circular array of sloped surfaces, such as 185, each terminating in an engaging plane 186. Surfaces 185 are sloped at approximately 45 degrees with the plane of the housing 21 broad surface and are approximately one-sixteenth of an inch along the slope by three-sixteenths of an inch wide, while engaging plane 186 is formed perpendicular to the housing 21 surface and is about .020 inches high by three-sixteenths of an inch wide. Pawl member 57 is an approximately one-half inch by one-eighth inch length of .012 inch thick flat spring steel bent upward one-eighth inches from one end at about 45 degrees. It is inserted into a well 187 in gear 177. In the prototype shown, it is held in place by a rivet 189 driven through a hole in gear 177 into the camstack 99, although preferably gear 177 would be molded in plastic with a molded slot to hold pawl 57 and 57 would be turned up slightly at its end in the slot to form a "barb" to hold it in the slot.

Figure 16:
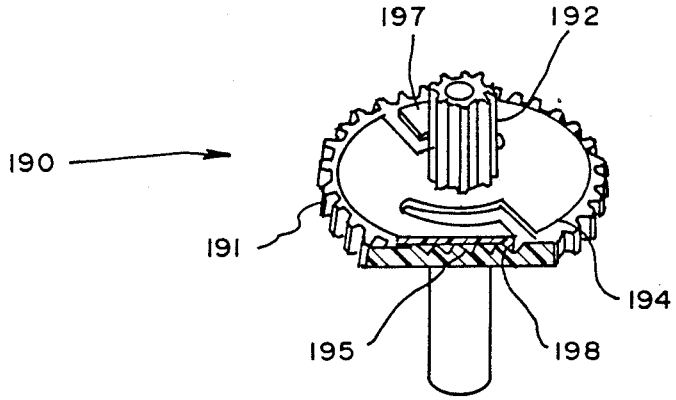
FIG. 16 is a perspective view of the one-way clutch.

Turning now to FIG. 16, the one-way clutch 190 is shown. It is associated with one of the gears 191 and pinions 192 in gear train 28. Gear 191 has an annular recess 194 which has a circular array of ramps 195 formed in it. Pinion 192 has a plate 196 formed with it which has flexible tongues 197 formed in it, which tongues have lugs 198 formed at the ends; the lugs 198 interact with ramps 195 to provide the clutching action. Such clutches are conventional in timers for appliances such as washers, dishwashers and dryers and will not be discussed further herein.

OPERATION OF THE DRIVE MEANS

The drive means 17 just described operates as follows. Motor 29 drives plate 194 in gear train 28 and rotates in a counter-clockwise direction as viewed from above in FIG. 16, causing lugs 198 to engage ramps 195 and turn gear 191 which drives the rest of the gear train 28 to rotate square drive shaft 166 in a counter-clockwise direction as viewed in FIG. 1. This drives camstack 99 in a clockwise direction, which in turn drives rake 182 in the same direction. In this direction of rotation, pawl 57 slips on ratchet member 58. If it is desired to rotate camstack 99 through its cycle swiftly, a manual or power-driven screwdriver is applied to one of screwdriver heads 174 or 180 and gear 175 is thus turned in a counter-clockwise direction while camstack 99 is turned in a clockwise direction. This movement will turn the gear 191 in a clockwise direction (when viewed from below in FIG. 16) allowing ramps 195 to slip on lugs 198. Thus the portion of the gearing 28 between the clutch 190 and the motor 29, and also the motor, does not turn and is not stressed. Moreover, the portion of the gearing 28 between clutch 190 and the screwdriver does not have the drag of the motor on it, and thus also is not stressed significantly. This allows the camstack 99 to be turned manually at a much higher rate than it would be turned by motor 29 without the stress to the gears 28 that would be caused by the higher turn rate. If it is attempted to turn the camstack 99 or gears 26 in the reverse direction, which could be done most easily with relatively large force by turning rake 182 in the counter-clockwise direction, the pawl 57 catches on one of the engaging planes 186 and the camstack 99 will not turn to transmit forces to the gearing 26, 28. This protects the gearing 25, 28 from large stresses that could be generated by manual turning of the rake or other part.

A feature of the invention is the positioning of the drive housing 23 by four pins 136–139. In the prior art icemakers, this housing is held in position by two screws. Because of the nature of screw-making, the screws will have undercuts under the head in the area that the screw locates the housing, or the screws would have to be relatively expensive. These undercuts results in loose tolerances in the positioning or registration of output drive 166. In addition, the act of tightening the screws also causes a variable amount of shift to the housing adding a further inaccuracy in registration. In contrast, pins 136–139 can be relatively inexpensively molded and located with precision and repeatability, both with regard to their position and their dimensions, to match the location and size of openings 163, thereby reducing the tolerances and increasing the accurancy of positioning. The manner of tightening, involving the clamping of the housing between the two housing portions, more evenly spreads the stresses of tightening, further increasing the accurancy of registration of the output shaft 166. In addition, more pins can be provided than screws at less cost, and since accuracy of registration is protortional to the number of location points, the four pins of the preferred embodiment provide twice the accuracy of registration of two screws on this factor alone. Thus the invention greatly increases the accuracy of registration of output shaft 166. This permits gears 175 and 177 to be located more accurately relative to one another, thereby reducing the stresses on the teeth of the gears that are created by misalignment. Another increase in accuracy of alignment of gears 26 is provided by the square drive of shaft 166 and the connector 170. This square drive permits play in the connection akin to a universal joint. This play permits a third bearing on the drive shaft, namely the bearing 71 in housing 21; this third bearing results in both the output drive 200 and the control means input drive 201 to be registered in the same part, which increases the accuracy of alignment of the gears 175 and 177 respectively attached to the drives. It is noted that the advantages of the accuracy of registration due to the drive mounting means 19 complements the one-way clutch advantages; i.e. the improved registration permits lighter gearing 26 (output end) while the clutch 190 and ratchet 58 permit lighter motor 29 and gearing 28. This complementarity permits lighter motor and gearing throughout the drive means 17 resulting in a balanced drive with the even stress distribution resulting therefrom. As a result, the drive means 17, including motor 29, gearing 28 and gearing 26 can be made lighter, smaller and more economically than in prior art icemakers with the same or greater reliability.

Another feature of the invention is that it is easier and less expensive to manufacture than previous icemakers. This lighter motor and gearing plus the one-way clutch and anti-back ratchet are less expensive than the heavy motor and gearing of previous icemakers. The drive mounting means replaces two screws with four pins. The pins are moldable with the housing and are less expensive than the screws. In addition, the screws require two additional operations during manufacture.

The result is an icemaker that is significantly less expensive to manufacture than prior art icemakers.

WATER QUANTITY ADJUSTING MECHANISM

Figure 5:
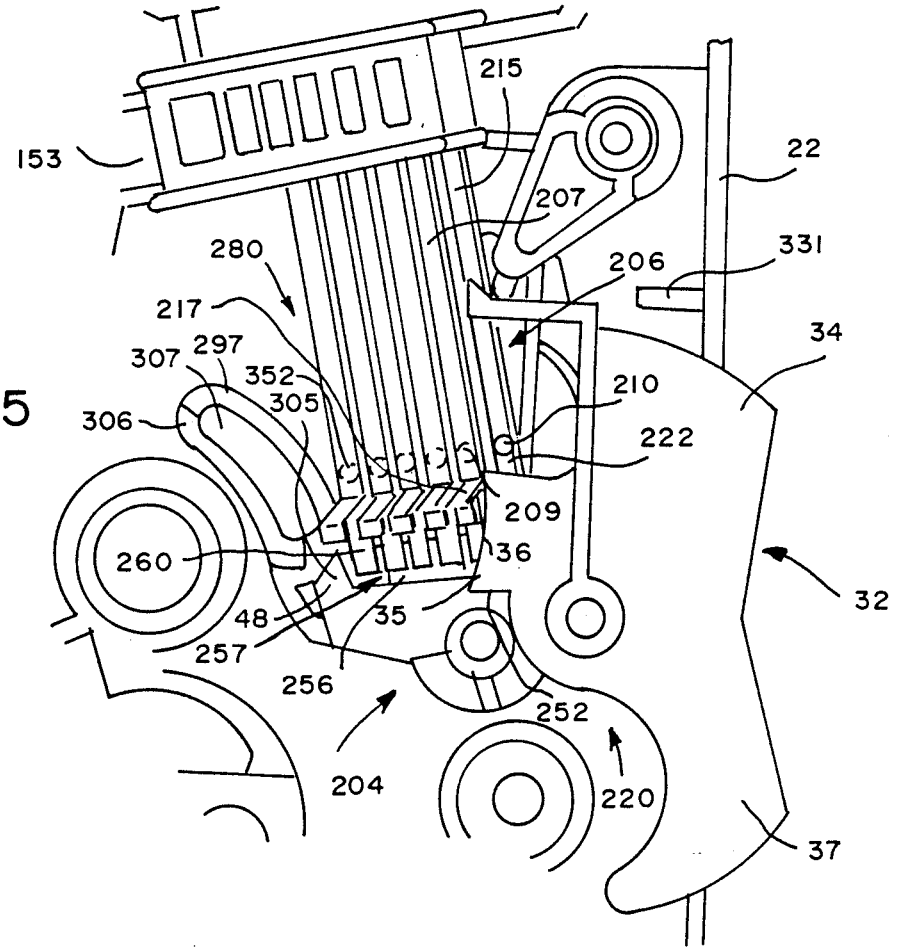
FIG. 5 is an orthogonal detailed view of the water control switch and adjustment mechanism.

Turning now to FIGS. 5 and 6, a more detailed view of the water quantity adjusting mechanism 204 is shown. In these FIGS. not all parts of the icemaker are shown in order to expose the working of the parts of interest. Water quantity adjusting mechanism 204 includes a first electrical switch 206 having a cantilevered switch blade 207, a first contact 209 (shown in dotted outline) mounted on the switch blade 207, and a second contact 210 cooperating with the first contact 209. The water adjusting mechanism 204 also includes a cam means 27 (best seen in FIG. 14) for actuating switch 206 for a period of time that varies as a function of the position of the second contact 210 relative to the cam means 27, an adjusting means 32 for manually adjusting the position of the second contact 210 relative to the cam means, and water delivery means 12 (FIGS. 1 and 13) responsive to the switch 206 for delivering to the water holding means 11 an amount of water related to the time the switch 206 is activated. Electrical switch 206 further includes a second switch blade 215 on which the second contact 210 is mounted. The first blade 207 has a cma follower 217 formed on its distal end. The switch 206 is one of a gang of five such switches all mounted on a bracket 157 which slides into a frame 153 molded into the control housing back portion 22. The adjusting means 32 includes a blade mover means 220 for moving the lower portion 222 of the second blade 215 away from the cam means 27. The blade mover means 220 preferably comprises an integral member 34 having a first portion 35 engagable with the blade 215 and a second portion 37 engagable by a manual operator. The first portion 225 includes a ramp means 36 which permits the locus of engagement, shown at 228 in FIG. 6, to move along ramp 36 as the blade end 222 is moved. This enables the member 37 to move over a greater distance than the blade, which provides for ease of manual control. The water quantity adjusting mechanism 204 also includes a setting means 230 for permitting the integral member 34 to be stably set to any one of a plurality of predetermined positions by the application of the operator's fingers to the portion 37 of the member. The setting means 230 includes a notched member 68 which has a plurality of notches 232 and a spring finger 235 integrally formed with member 34. Finger 235 has a pointed lug 237 on its distal end which springs into notches 232 to stably hold the integral member 34 in the predetermined position in which it is set. By "stably" is meant that the member 37 will not move if lightly hit, as say when it may be brushed by an arm retrieving ice, but at the same time responds to firm pressure applied by fingers. The notched member 38 is integrally molded with front housing cover 21 as best seen in FIG.2. The portion 37 of integral member 34 that is manually engagable includes a lower portion 240 that is engaged to move the finger 235 in the clockwise direction (in FIG. 6) and an upper portion 241 that is engaged to move the finger 235 in the counter-clockwise direction. Integral member 34 also includes a bearing 243 which pivots on journal 54 of brace 52 (FIG. 1). It also includes a flange 245 which supports finger 235 and the back edge 246 of which serves as a stop that contacts housing wall 60 to prevent finger 235 from moving so far as to disengage notched member 68. A circular cut-out 247 in member 34 permits the member to avoid port 96; the distal end 249 of member 34 is designed to engage webbing portion 250 (FIG. 2) at the same time as edge 246 engages wall 60 so that it also acts as a stop. In the other pivot direction edge 252 of member 35 butts against arm 254 of brace 52 to serve as a stop. Brace 52 includes a flange 256 which abuts the lower ends 257 of the three middle blades in the gang 30 of blades to stabilize the lower end of the gang 30 and prevent the middle blades from moving when either of the end blades 215 or 260 are moved. (See discussion below with respect to movement of blade 260).

Cam means 212 preferably comprises the largest diameter track 262 on camstack 99. The track includes a short cam 264 which is shaped to provide a water fill time of between 6 second and 9 second depending on the setting of member 34. Switch 206 is connected to a water delivery means 12 comprising a solenoid 266 which is generally located in the same compartment of the appliance as the compressor, water line 268, and water fill tank 269. The solenoid 266 controls water flow in water line 268 which carries water to water fill tank 269 which distributes the water to holding means 11. Camstack 99 is a conical camstack which permits gang 30 to be turned at an angle so that more switches are operable with a given length of camstack. This also permits the gang 30 to be set in an angle between the housing walls. The shorter camstack 99 and angled position gang 30 enables the five switch gang to be incorporated in an icemaker control housing 20 of the same size as those in the prior art.

OPERATION OF THE WATER QUANTITY ADJUSTING MECHANISM

The water quantity adjusting mechanism 204 just described operates as follows. Camstack 99 is rotated by drive means 17 in a clockwise direction as described above. After the ice bodies are removed from holding means 11 by rake 182, cam 264 raises cam follower 217 and closes switch 206. This activates solenoid 266 which opens a valve to allow water to flow through line 268 to water fill tank 269 which distributes it to water holding means 11. When the camstack turns far enough for the cam follower 217 to fall off cam 264, the switch 206 opens and solenoid 266 shuts off the water. The length of time the switch 206 is closed, and thus the amount of time solenoid 266 is open and the amount of water delivered by line 268, is determined by the separation between contact 210 and cam 264. This distance is adjusted by member 34 which lifts spring end 222 via ramp 36 a variable amount determined by the position of member 34. The ramp means 36 is preferably shaped so that equal amounts of movement of member 34 will corresponds to equal time increments and thus equal water quantity increments. Notches 232 are equally spaced on member 68, thus the predetermined settings determined by the notches correspond to equal increments of water or ice body volume. The ramp could also be shaped to provide equal increments of ice body size or any other incremented quantity as desired.

In another aspect, the amount of water delivered to water holding means 11 depends on the relative positions of contacts 209 and 210 in the state where follower 217 is not in contact with cam 264. Thus the adjustment of the position of contact 210 could be seen as an adjustment of the distance between contacts 209 and 210.

A feature of the invention is the use of the cantilevered blades 207 and 215 and their being part of a gang of switches 30. The switch gang 30 with five switches is less expensive than a single microswitch. Thus five switches are provided at less than the cost of one. This results in significant lowering of the expense of manufacturing an icemaker.

Another feature of the invention is the precise and continuous control of the position of blade 215 by the ramp means 36 and the smooth action of blade switches. This contrasts to the rather abrupt action of microswitches. Further, in the prior art, the water fill quantity had to be adjusted at some point during its manufacture by locating the microswitch by moving it or some other member, then tightening the piece moved with a screw. This is a time consuming and therefore costly manufacturing operation. The variation of pre-travel vs. overtravel that is typical of microswitches requires this special adjustment. The smooth action of the invention's switching coupled to the precision location of contacts by the distal end positioning and further coupled to the improvement to cam dwell angle provided by the U.S. Pat. No. 4,697,432 art combine to eliminate the need for special "fill time" adjustment at the point of manufacture. In addition to being easily settable, the adjusting means 32 also resists accidental movement of the member 34 by someone obtaining ice, for example. This is also an improvement over prior art icemaker water quantity adjustment mechanisms.

THE BAIL MECHANISM

Turning now to FIGS. 5, 7, 8, 9, 10, 11, and 12, the bail mechanism 33 shall be discussed. The bail mechanism includes a bail means 270 for moving between a position for operating the icemaker and a position for stopping the icemaker, bias means 272 for raising the bail means 270 towards the position for operating the icemaker, and latching means 274 for latching the bail means 270 in stopping position. The bail means 270 preferably includes a u-shaped bail 40 having ends 275, and 276 both of which are bent in the same direction parallel to the base of the U; end 276 is formed in a flattened S shape. Bail means 270 also includes flange 27 having a bearing in it and rotatable member 42 having a journal 82 which rotates in socket 81 of housing portion 21 as discussed above, a cylindrical connector shaft 41 which rotates in bearing 108 in central housing portion 22, and a circular flange 279. End 275 rotates in bearing 278. Connector shaft 41 has a rectangular slot 281 with rounded ends (FIGS. 10 and 11) in which end 276 fits to secure bail 40 to the rest of the bail mechanism 33. Flange 279 provides a shoulder to abut bearing 108.

Bias means 272 includes spring 50, provides member 44, hollow, V-shaped arm 283, a bearing member 43 and cantilevered blade 260 which is part of switch 280, the farthest rear switch (in FIG. 1) of switches 30. Arm 283 and member 43 are integrally formed with rotatable member 42. A reinforcing flange 285 connects arm 283 and bearing member 43. Bearing member 43 is primarily cylindrical and has a smooth circular bearing surface 287. It has a recess 288 which is shaped like a wide V with a first bearing surface 290 and a second bearing surface 291, all of which are part of latching means 274.

Pivotable member 44 is preferably an integrally molded piece which includes a cylindrical bearing 295, a first arm 297, a second arm 288, and a finger 48. A semi-circular collar 299 is formed at the joinder of arm 297 and 298. A reinforcing flange 300 extends from collar 299 under bearing 295. An L-shaped bracket 302 is molded to arm 298 with the toe of the L attached to the arm 298 and the body of the L forming a notch 304 in the arm 298. Arm 297 has a bow-shaped cam follower extension 306 and a hollowed out area 307 to lighten it. Likewise arm 298 has hollowed out areas such as 308. Finger 48 has a pointed end 305 with a flat surface 309. Spring 50 includes a hook-shaped portion 310, with a reverse curve on the end 311 of the hook 310, a coil portion 314, and a tail end 316 on the coil portion 314. Below and in the claims we shall refer to spring end 316 as the "first end" of the spring and end 311 as the "second end".

The various parts of the bias means fit together as followers. Bearing 295 pivots on shaft 53 of bracket 52, with cylindrical bearing 43 fitting loosely in notch 320 between fingers 45 and 46, Spring 50 abuts against flange 299 and the joint of arms 297 and 298. Arm 315 of spring 50 fits in notch 304 to engage arm 298. Cylindrical support 325 of brace 52 acts as a first stop 325 to stop the first end 316 of spring 50, so that the coil portion 314 pushes against arm 298 via bracket 302. A shelf 330 on control housing portion 22 and a portion of wall 100 serves as a second stop 334 to stop the second end 311 of spring 50.

Latching means 274 comprises the biasing means parts discussed above in combination with the tip 340 of finger 45, surfaces 290 and 291 of recess and shelf 330, wall 100 and flange 331 of housing portion 22.

Figure 11:
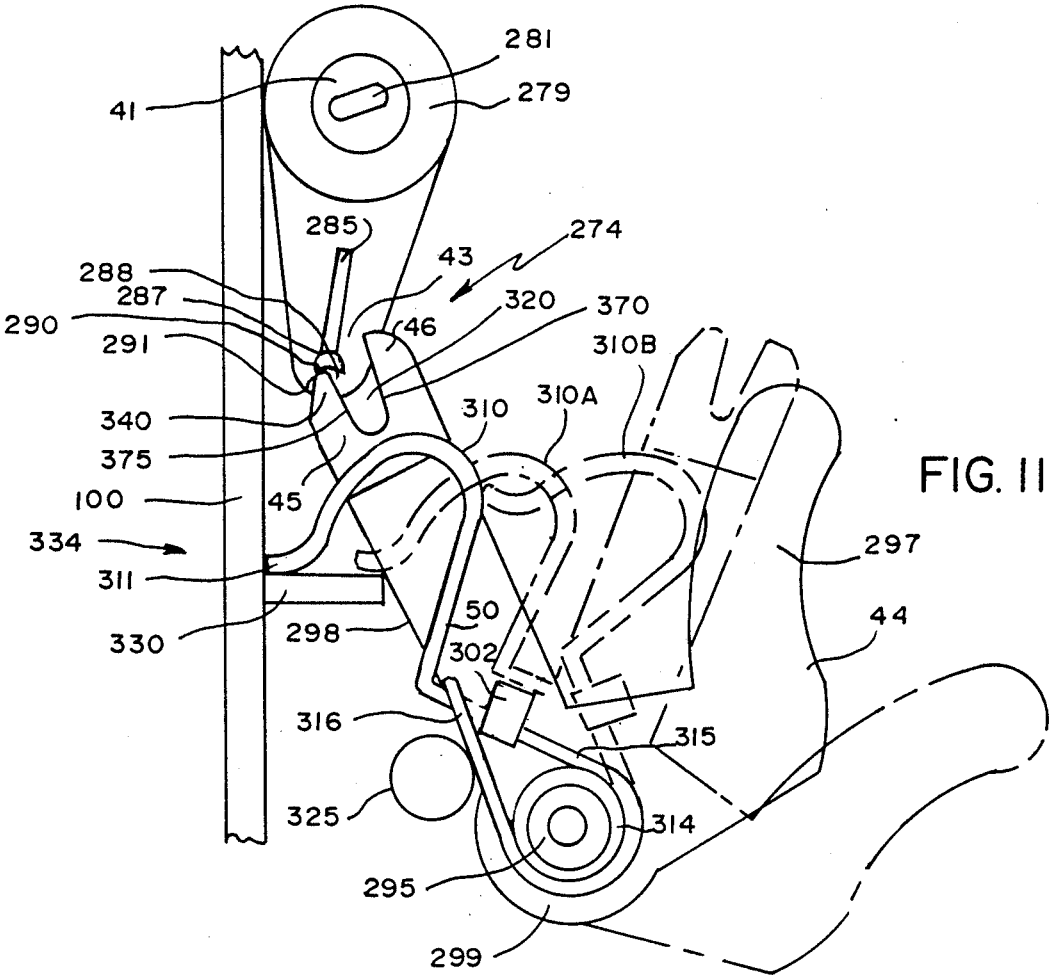
FIG. 11 is a detailed view of the compound spring showing it in three different configurations.
Figure 12:
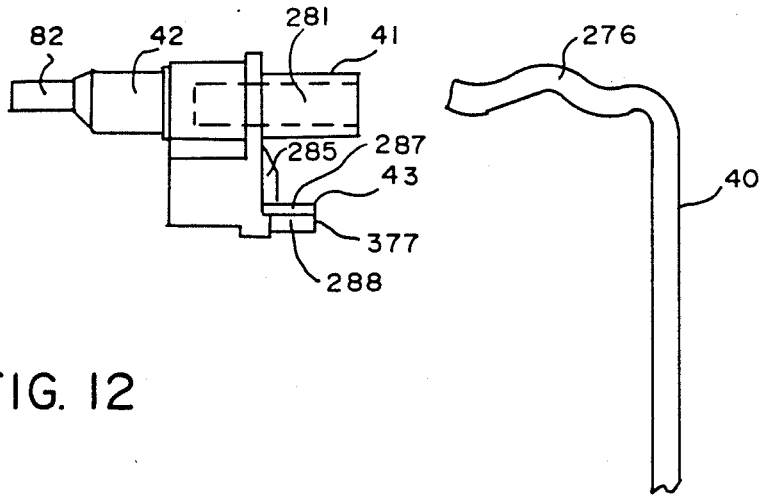
FIG. 12 is a detailed view of the interconnection between the bail and the bail switch mechanism.

The tip 340 is shaped so that the force of spring 50 tending to rotate arm 298 in the clockwise direction in FIG. 11 will exert a force on recess 288 surface 290 tending to push it in a direction through the axis of rotation of member 42. Or, alternatively, to push surface 290 in the clockwise direction. This is because the shape of tip 340 and recess 288 is such that tip 340 pushes into the V of the recess, or it has to push surface 290 up. Surface 290, if pushed up, would rotate in the clockwise direction. However, because of wall 100 it cannot move clockwise, which latches the mechanism. In the latched-up position, if sufficient external force is applied to bail 40, it can rotate so that arm 283 roates counter-clockwise. Then the vector sum of both spring 50 and the external forces push tip 340 down slightly (there is some give to the parts) to get past the locking point and the system is unlatched.

OPERATION OF BAIL MECHANISM

Figure 4:
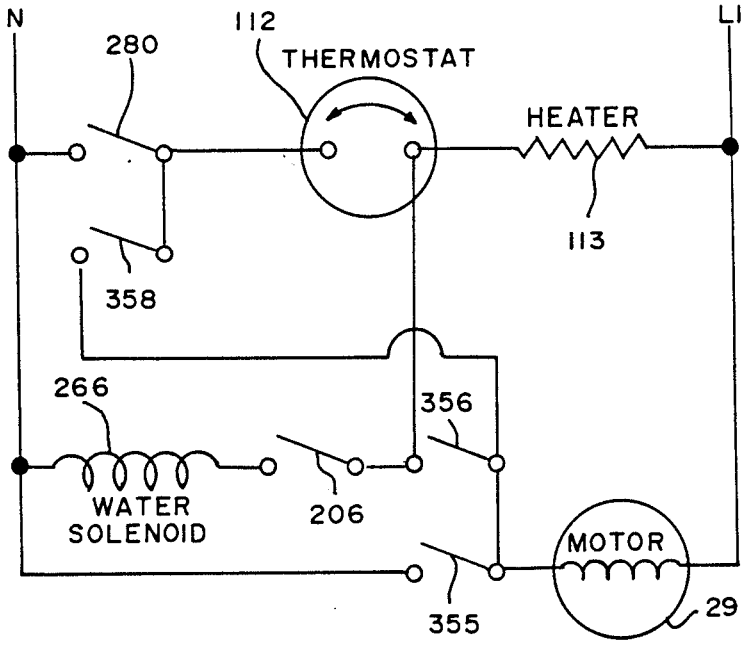
FIG. 4 is an electrical circuit diagram of the icemaker control means.

Referring to FIG. 4, as is generally known in the art, while the ice is forming in the icemaker, the switch 356 will be closed which causes motor 29 to begin to run when thermostat 112 closes, if switch 280 is also closed. Switch 355 then closes. As discussed above, motor drive 17 then drives camstack 99 via gearing 28 and 26 to turn the rake 182 to eject the ice. After the ice has been ejected, camstack 99 continues turning and as it rotates a cam track 350 (FIG. 14) on camstack 99, lifts cam follower 306 on arm 297 and rotates the bail mechanism 33 clockwise lifting bail 40. Switch 356 then opens and switch 358 closes. As the camstack continues to turn, the surface 309 (FIG. 5) of end 305 of finger 48 lifts spring 260 which separates contacts 352 to open switch 280. Switch 355 is closed at this time and motor 29 continues to run. As the camstack 99 continues to rotate, cam follower 306 falls off cam track 350. If the ice bin 15 is filled beyond a predetermined level, then bail 40 does not fall completely, and switch 280 remains open. Thus, as soon as switch 355 opens the icemaker will be de-energized until some ice is removed and the bail drops below the predetermined level which causes member 44 to rotate far enough for finger 48 to permit the switch 280 to close. The predetermined level is the level determined by the level at which finger 48 holds contacts 352 just open; generally this is the level at which the ice bin is full. If the bin 15 is not filled beyond the predetermined level, then the bail immediately drops far enough to close switch 280 and the camstack continues to rotate until switch 355 opens. The icemaker then is quiescent until the thermostat again turns on.

Figure 8:
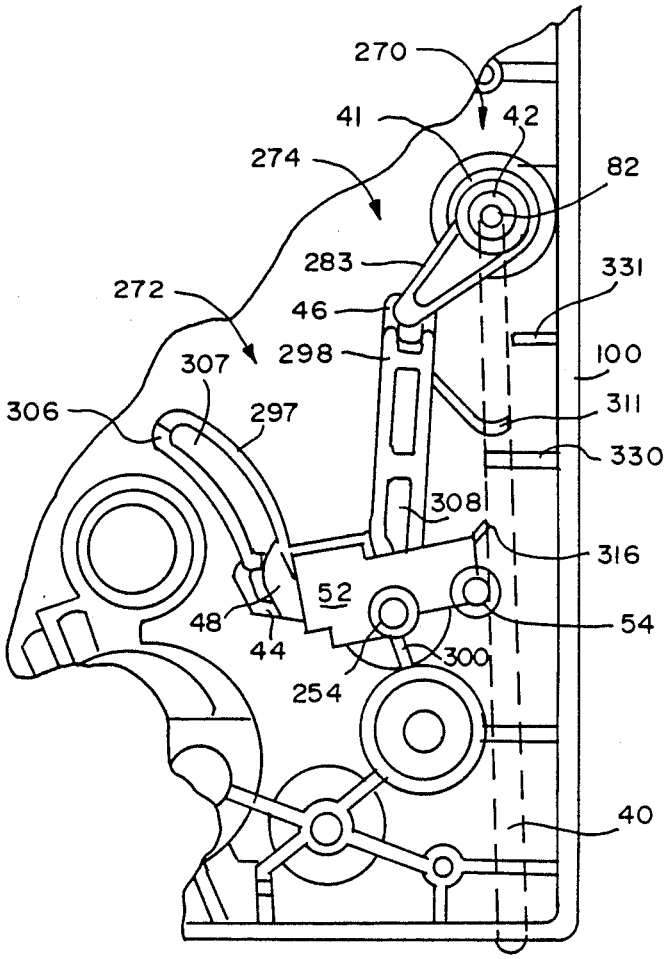
FIG. 8 is a view of the bail mechanism and switch of FIG. 7 in the bail down position.
Figure 9:
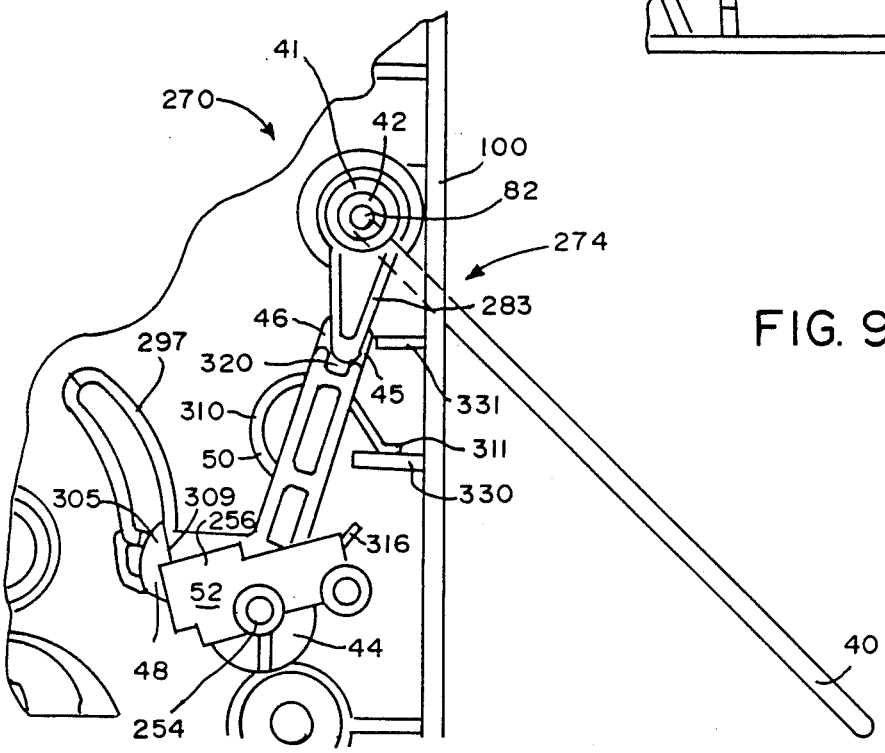
FIG. 9 is a view of the bail mechanism and switch of FIG. 7 with the bail up but not locked.
Figure 10:
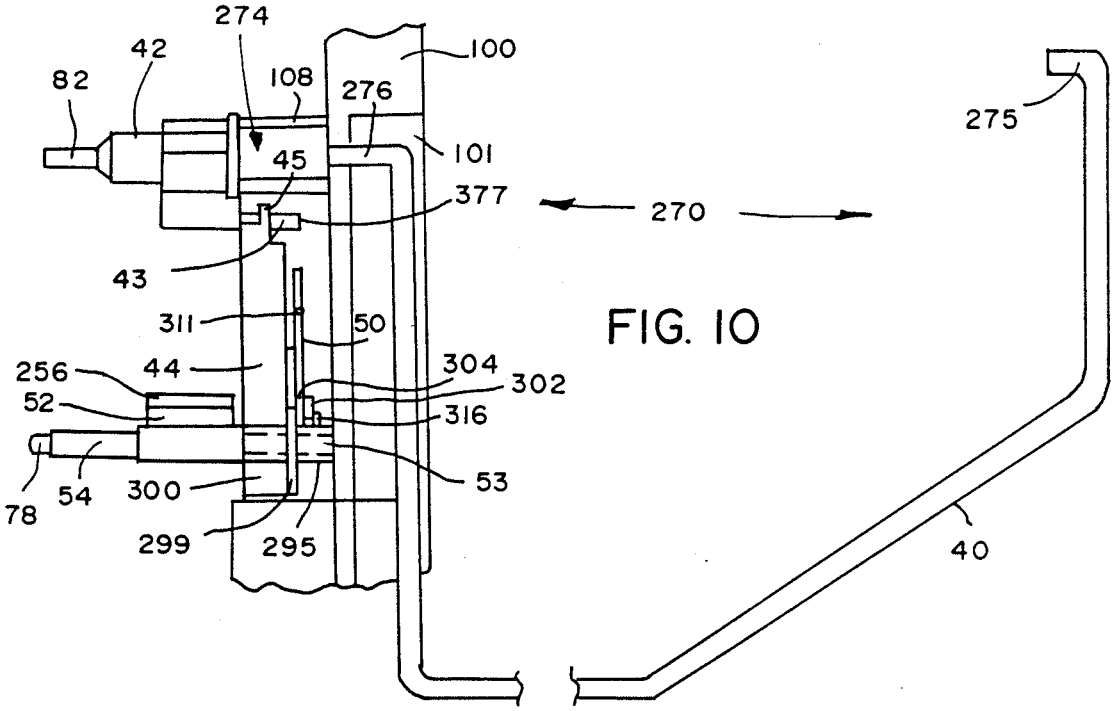
FIG. 10 is a side view of the bail mechanism and switch of FIG. 9.

As discussed above, the spring 50 provides a bias force to urge the bail mechanism toward the operating position, i.e. so that member 44 rotates counter-clockwise in FIGS. 7, 8 and 9 and bail 40 rotates clockwise. The view in FIG. 11 is from the other side of member 44 so the directions of rotation are reversed. The spring 50 is a compound spring in that it provides a plurality of qualitatively different bias forces. By "qualitatively different" means that the nature of the spring action changes, as opposed to, for example, spring forces that change steadily and continuously following Hookes's law as the spring is compressed or released. In the preferred embodiment, when rotatable member 44 is rotated clockwise in FIG. 11 so that hook 310 is in the position shown at 310B, the spring 50 responds as a torsion spring. Coil 314 is compressed between stop 325 which stops end 316 and bracket 302. In this position, end 311 of the spring 50 is free to move with arm 298 and bracket 302. In the full counter-clockwise position hook 310 is stopped against wall 100 and shelf 330, and the length of the spring between end 311 and the coil 314 acts as a leaf spring with bracket 302 exerting force on the spring between the two ends of the leaf. The leaf spring force is substantially greater than the torsion spring force, preferably approximately twice the torsion spring force, so that the spring responds mainly as a leaf spring. The net force will be in this case approximately three times the force as compared to just the torsion spring response. In the position shown by the hook 310A (best seen in FIG. 11) the end 311 of spring 50 is stopped from moving in the vertical direction by shelf 330, but it is free to move in the horizontal direction. The nature of the spring response in this position will be between that of a torsion and a leaf spring, and the force will be intermediate to the force of the torsion spring alone and the torsion and leaf springs together. The spring thus provides three qualitatively different bias forces over three different ranges of movement of the bail mechanism. The first range is the range from the position when member 44 is as far clockwise in FIG. 11 as it can go to the position where end 311 first contacts shelf 330. This range includes the range of movement where the drive means 17 will drive the bail. The second range is the range where spring end 311 is stopped against wall 311. This range starts priot to the end 340 of finger 45 entering recess 288, and goes to the farthest counterclockwise (in FIG. 11) position that member 44 can go. The third range is the range between the first and the third range. In this range end 311 slips on shelf 330.

The latching of the bail mechanism 33 occurs as follows. In the automatic operation of the icemaker bearing 43 lies between fingers 45 and 46 in notch 320 and the inner surface 370 of finger 46 engages bearing surface 287. However, if the bail 40 is raised manually, bearing surface 287 acts against the inner surface 375 of finger 45. The end 377 (FIG. 10) of bearing 43 slides on flange 330 in housing body portion 22 which provides additional stability to the mechanism for the latching operation. As bearing 43 passes the lowest point in its movement (just after the position of the parts shown in FIG. 9) and begins to rise upward and to the right (in FIG. 9) toward wall 100, a point is reached where the lip 291 where bearing surfaces 290 and 287 meet is higher than the tip 340 of finger 45, and finger 45 snaps back into recess 288 due to the bias force of the spring. In the recess, the finger 45 will, in response to spring 50, preferably push up along the radius toward the axis of rotation of rotatable member 42 (along the line of flange 285 in FIG. 11). Surface 290 is angled appropriately so that the force vector from tip 340, being applied from spring 50, forces bearing 43 into wall 100.

If, however, the bail 40 is pushed downward sufficiently to overpower the spring 50 force, the member 42 rotates counter-clockwise in FIG. 11. There is some give to shaft 53 and the lip of surface 290 rises over finger 45 and the bearing 43 returns to the position in the notch 320. This return is aided by the shape of the tip 340 and surface 290 which causes the bearng 43 to be thrusting toward socket 320 when the bail is pushed down. In summary, the shape of the parts 43 and 45 is such that when the finger 45 is pushing on bearing member 43 in the latching position, it is driving into the V of recess 288, but when bearing 43 is exerting force on finger 45, it is pushing into the notch 320.

A feature of the invention, is that it provides a relatively complex response with relatively inexpensive parts. The different response of the spring 50 in the three different ranges in turn permits a less expensive drive mechanism, while at the same time providing an enhanced feel to the manual movement of the bail.

The parts of the invention are preferably made of the following materials: control housing portions 21 and 22 are molded of rigid PVC or other suitable plastic; member 44, member 34, member 42, camstack 99, bearings 175 and 177, connector 170, bin 15, and shafts 72 and 73 are all preferably molded of acetal or similar plastic. Pawl 57 and spring 50 are preferably made of tin-plated spring steel. Rivet 187 and screws 160 are preferably steel or other suitable metal. The switch blades, such as 260, are preferably made of #260 brass, while the contacts, such as 210, are made of 90–10 Ag Nu. Bracket 157 is preferably made of polycarbonate or other suitable insulating material. Brace 52 is preferably made of acetal, polycarbonate or other similar material. Shaft 166 is preferably made of glass-reinforced nylon. The motor 29 and gear train 28 is a Mallory M008 Model as mentioned above. The mover means 14, holding means 11, delivery means 12 and bail 40 are conventional.

A novel icemaker has been described having an improved bail mechanism that results in a more reliable and less expensive product and has a better feel than prior art icemaker bail mechanisms, and has numerous other advantages. It is evident that those skilled in the art may now make numerous uses and modification of and departures from the specific embodiment described herein without departing from the inventive concepts. For example, more than one spring could be used, or the spring could be replaced with a different compound spring or other biasing device. Equivalent parts could be used for most of the other aspects described. Many other variations and features may be added. Consequently, the invention is to be construed as embracing each and every novel feature and novel combination of features present and and/or possessed by the icemaker described.

What is claimed is:

1. In an icemaker of the type comprising water holding means for holding water in a cold area to form ice bodies, water delivery means for delivering water to said water holding means, ice mover means for moving ice from said holding means into an ice storage bin, and control means for controlling the operation of the icemaker, the control means including bail means for moving between a position for operating the icemaker and a position for stopping the icemaker, bias means for biasing the bail means towards the position for operating the icemaker, drive means for moving the bail means to the stopping position and returning it to the operating position provided the bin is not filled to a predetermined level, and latching means for latching said bail means in stopping position to thereby deeenergize the icemaker regardless of the amount of ice in the storage bin, the improvement wherein said bias means comprises a compound bias means for biasing said bail means towards said operating position with a first bias force over a first range of movement of said bail means and for biasing said bail means towards said operating position with a second bias force qualitatively greater than said first bias force over a second range of movement, said first range including the range of movement over which the drive means moves said bail means, and said second range including a range over which said bail means moves just prior to the position at which said latching means operates.

2. An icemaker as in claim 1 wherein said second bias force is two or more times greater than said first bias force.

3. An icemaker as in claim 1 wherein said bias means further comprises means for biasing said bail means with a third bias force over a range movement of said bail means between said first and second ranges, said third bias force being between said first and second bias forces.

4. An icemaker as in claim 1 wherein said compound bias means comprises spring means for responding as a torsion spring over said first range of movement and as a leaf spring over said second range of movement.

5. An icemaker as in claim 3 wherein said compound bias means comprises an arm, a spring having a first end and a second end, and a first stop means for stopping the movement of the first end of said spring over said first, second, and third ranges of movement, and wherein said second end of said spring is free to move over said first range of movement and said arm engages said spring between said first and second ends of said spring.

6. An icemaker as in claim 5 wherein a portion of said spring between said first end and the point of engagement of said arm and said spring comprises a torsion spring.

7. An icemaker as in claim 6 and further including second stop means for stopping the movement of said second end when said bail means is in said second range.

8. An icemaker as in claim 7 wherein said second stop means further comprises means for stopping the motion of said second end in a first direction while permitting it to move in a second direction when said bail means is in said third range.

9. An icemaker as in claim 1 wherein said bail means includes a bail rotatable about an axis and wherein said bias means urges said bail in one direction about said axis when said bail means is in said second range and urges said bail in another direction when said bail means is in said latching position.

10. An icemaker as in claim 9 wherein said latching means comprises a finger through which said bias means acts on said bail, a bearing surface connected or connectable to said bail and rotatable about said axis, said bearing surface having a recess therein, wherein said finger slides against said bearing surface when said bail means is in said second range of movement and enters said recess as said bail means reaches said latching position, and wherein said finger, said bearing surface and said recess are shaped so that the action of said bias means acting through said finger on said bearing surface is in a direction tending to rotate said surface in said one direction about said axis when said bail means is in said second range and is either in a direction through said axis or in a direction tending to rotate said surface in the opposite of said one direction when said finger enters said recess.

* * * * *